United States Patent [19]

Priem et al.

[11] Patent Number: 4,958,146

[45] Date of Patent: Sep. 18, 1990

[54] MULTIPLEXOR IMPLEMENTATION FOR RASTER OPERATIONS INCLUDING FOREGROUND AND BACKGROUND COLORS

[75] Inventors: Curtis Priem, Fremont; Chris Malachowsky, Santa Clara, both of Calif.; Thomas Webber, Lynn, Mass.

[73] Assignee: Sun Microsystems, Inc., Mountain View, Calif.

[21] Appl. No.: 257,853

[22] Filed: Oct. 14, 1988

[51] Int. Cl.[5] ..... G09G 5/40

[52] U.S. Cl. ..... 340/703; 340/701; 340/798; 340/799

[58] Field of Search ..... 340/703, 701, 798, 799

[56] References Cited

U.S. PATENT DOCUMENTS

| | | | |
|---|---|---|---|
| 4,509,043 | 4/1985 | Mossaides | 340/703 |
| 4,641,282 | 2/1987 | Ounuma | 340/703 |
| 4,689,613 | 8/1987 | Ikeda | 340/703 |
| 4,742,474 | 5/1988 | Knierim | 340/799 |
| 4,766,431 | 8/1988 | Kobayashi et al. | 340/799 |

*Primary Examiner*—Jeffery A. Brier

*Attorney, Agent, or Firm*—Blakely, Sokoloff, Taylor & Zafman

[57] ABSTRACT

A mulitplexor implementation of circuitry for performing Boolean raster operation in a workstation whose functions include the display of graphics images using multiple planes and having foreground and background colors. The invented circuitry includes a plane raster-op select circuit and Boolean raster-op circuit. The plane raster-op select circuit selects a Boolean raster operation to be performed for each plane of graphics information as a function of foreground and background color control signals. The selected Boolean raster operation for each plane is then input to set of mulitplexors and the selected Boolean raster operation is performed on the control inputs to the multiplexors which combines source and destination data for each plane according to the selected Boolean operation for that plane.

7 Claims, 4 Drawing Sheets

MULTIPLEXOR IMPLEMENTATION FOR RASTER OPERATIONS INCLUDING FOREGROUND AND BACKGROUND COLORS

SUMMARY OF THE INVENTION

The present invention is directed to a multiplexor implementation of circuitry for performing Boolean raster operations in a workstation whose functions include the display of graphics images using multiple planes and having foreground and background colors. The invented circuitry includes a plane raster-op select circuit and a Boolean raster-op circuit. The plane raster-op select circuit selects a Boolean raster operation to be performed for each plane of graphics information as a function of foreground and background color control signals. The selected Boolean raster operation for each plane is then input to a set of multiplexors and the selected Boolean raster operation is performed on the control inputs to the multiplexors which combines source and destination data for each plane accordingly to the selected Boolean operation for that plane.

DETAILED DESCRIPTION OF THE INVENTION

The present invention is directed to an apparatus and method for use in a computer system used for the graphic display of images. Although the present invention is described with reference to specific circuits, block diagrams, signals, truth tables, bit lengths, pixel lengths, etc., it will be appreciated by one of ordinary skill in the art that such details are disclosed simply to provide a more thorough understanding of the present invention and the present invention may be practiced without these specific details. In other instances, well known circuits are shown in block diagram form in order not to obscure the present invention unnecessarily.

Figure 1:
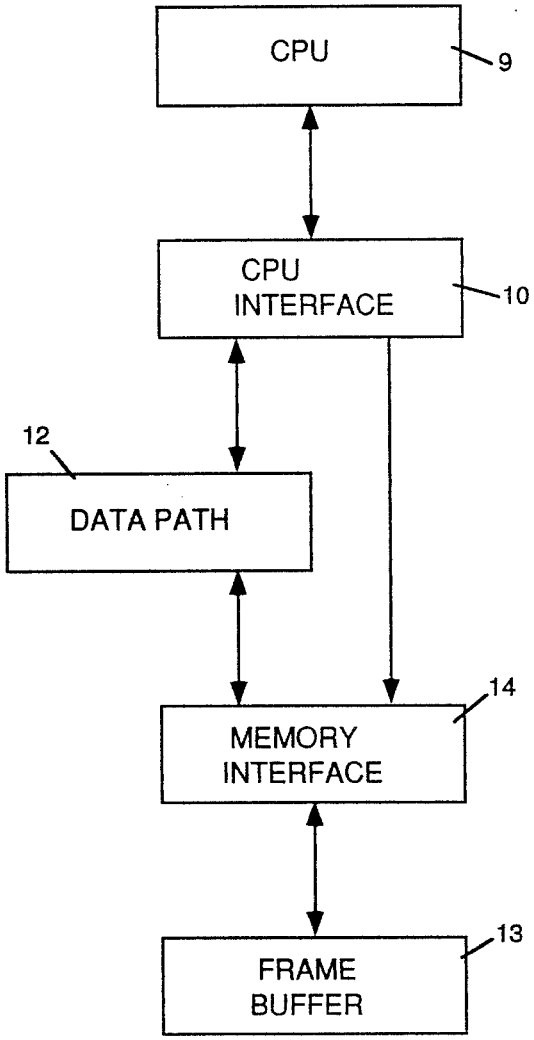
FIG. 1 is a block diagram showing the environment of the present invention.

In FIG. 1 there is shown a general block diagram of the environment of the present invention. CPU 9 is defined herein as embracing circuitry external to the other components shown in FIG. 1, and provides data, control signals and addresses through CPU interface 10 necessary for the operation of the invention herein described.

CPU 9 through CPU interface 10 also provides addresses to a memory interface 14 and data to data path circuitry 12. The data path circuitry 12 is also provided with data which is read from a display frame buffer 13 by memory interface 4. Data is outputted by data path circuitry 12 to memory interface 14 for writing therefrom to the frame buffer at an address provided by CPU 9. The present invention is directed to specific circuitry and techniques in data path 12. Details concerning CPU 9, CPU interface 10, frame buffer 13 and memory interface 14 will be apparent to those skilled in the art of computer created graphics displays and are therefore not set forth herein except as needed for a proper understanding of the invention.

Data path circuitry 12 will now be described in detail with reference to FIG. 2, which is a functional block level diagram of the data path circuitry 12 of FIG. 1. For purposes of the following explanation, the terms "destination" and "source" data will be introduced. Destination data is data which is written into the frame buffer or is the data currently residing at the address in the frame buffer about to be written. Source data is data which is provided from one of three sources, the CPU 9, which provides font source data to font register 20, a pattern register 27 which stores a predetermined pattern and provides pattern source data, or source block register 24 which provides frame buffer source data. Pattern register 27 contains pattern source data, while source block register 24 supplies source information read from the frame buffer via memory interface 14. The data path circuitry 12 combines source data with the destination data and produces new destination data which is written to a desired location of the frame buffer, which in turn, is ultimately displayed on a video display.

Destination data, which is stored in destination latch 78, is read from the frame buffer at an addressed memory location of the frame buffer 13 via memory interface 14. The appropriate addresses are provided to memory interface 14 from the CPU 9. The destination data is held in latch 78 and then combined, by a Boolean operation specified by CPU 9, with one of the three sources of data supplied by font register 20, pattern register 27 or source register 24 as will be described below in more detail. The combination of a source and destination data yields a new destination data which is channeled through destination data output latch 74 and written to a location within the frame buffer memory specified by an address supplied by CPU 9 to memory interface 14.

In one mode of operation, the present invention combines font source data (supplied by font register 20) with frame buffer destination data (supplied by latch 78). then a display of font data is requested by a user, CPU 9 issues a command which causes font register 20 to output its font data. This data is then selected by multiplexor 30, as controlled by CPU 9, and selected again by multiplexor 32 and inputted into barrel shifter 36.

Multiplexors 30 and 32 select the sources of data to be input to barrel shifter 36 as between font register 20 and pattern register 27 (multiplexor 30) and as between the output of multiplexor 30 and source register 24 (multiplexor 32). Barrel shifter 36 moves the font data from multiplexor 32 over a predetermined amount of bits so that it lines up over, for example, a 16 pixel memory access within frame buffer 13. For example, when a ten bit wide font is written which begins at the thirteenth pixel memory location of frame buffer 13, barrel shifter 36 is instructed, by CPU 9, to shift the font data over thirteen places, so that the beginning of the font data is aligned with the thirteenth address within the frame buffer 13 in the 16-pixel portion of frame buffer memory that will be operated on. It will therefore be appreciated that barrel shifter 36 is used for alignment so that when font data is written into the frame buffer memory, the font data will align in the correct memory location as determined by the address sent thereto by CPU 9.

The shifted over data supplied by barrel shifter 36 is channeled into a set of eight bit latches 46, 48, 50, 52, 54, 56, 58 and 60 through MUXes 45, 47, 49, 51, 53, 57, 59 and 61 respectively. This set of latches store one pixel worth of data which will be written into the frame buffer (8 pixels total).

The present invention uses eight 8 bit latches so that each latch 46, 48, 50, 52, 54, 58 and 60 can store eight bits of data, and therefore contain eight planes of information (as described below with reference to FIG. 3 for each of eight pixels. The eight pixels of information will be half of a memory access since, in the preferred embodiment, a frame buffer memory space of 16 pixels, (which corresponds to 16 pixels of a video display) may be updated in one memory access. The remaining eight pixels of information from the next memory access are sent to barrel shifter 36 and are distributed to latches 46, 48, 50, 52, 54, 56, 58 and 60 in the second half of the memory cycle operation in the same manner as the first. Font data is available in 1 bit per pixel mode (Font-1) for monochrome or 8 bit per pixel mode (Font-8) for color. In Font-1 mode, expand circuitry 42 replicates the 1 bit per pixel eight times. Latches 46, 48, 50, 52, 54, 56, 58 and 60 supply the font source data, eight bits at a time, to an input of Boolean raster-op circuit 64 which is described below with reference to FIG. 4. The frame buffer destination data held in destination latch 78 is coincidentally released and channeled to a second input of Boolean raster-op 64.

Plane raster-op select 62 which is also described below with reference to FIG. 4 and Boolean-raster-op circuit 64 then combine, by way of a selected Boolean operation, the frame buffer destination data from latch 78 with the font source data from latches 46, 48, 50, 52, 54, 56, 58, 60 which were originally supplied by font register 20. The possible Boolean operations which are common to graphics displays are shown in Table 1.

TABLE I

| NUMBER | OPERATION | DESCRIPTION |
|---|---|---|
| 0 | CLEAR | d <– (0) |
| 1 | NOR | d <– (~((d) \| (s))) |
| 2 | ERASE | d <– ((d) & ~(s)) |
| 3 | DRAW INVERTED | d <– (~(s)) |
| 4 | ERASED REVERSED | d <– ((~(d) & (s)) |
| 5 | INVERT | d <– (~d)) |
| 6 | XOR | d <– ((d) ↑ (s)) |
| 7 | NAND | d <– (~(d) & (s)) |
| 8 | AND | d <– ((d) & (s)) |
| 9 | EQUIVALENT | d <– (d) ↑ ~(s)) |
| 10 | NOP | d <– (d) |
| 11 | PAINT INVERTED | d <– (d) \| ~(s)) |
| 12 | DRAW | d <– (s) |
| 13 | PAINT REVERSED | d <– (~(d) \| (s)) |
| 14 | PAINT | d <– ((d) \| (s)) |
| 15 | SET | d <– (~0) |

where

~=one's complement

|=OR

~=EXCLUSIVE OR

&=AND d=destination data s=source data

The source and destination data are combined by plane raster-op select 62 and Boolean raster-op 64 in the following fashion. CPU 9 provides to plane raster-op select 62 four groups of four bits via data line 65. Each group of four bits encodes one of 16 possible Boolean operations. Plane raster-op select 62 is provided with, also by CPU 9, foreground color (FGC) and background color (BGC) status signals for each of eight planes. The FGC and BGC signals represent, respectively, the foreground and background colors of the image being rendered on the video display. It will be appreciated that higher bit resolutions and more than two colors may be used.

Since for each plane there are four possible combinations of the FGC and BGC signals at the input of plane raster-op select 62, one of the four groups of four bits are selected as determined by the FGC and BGC signals. The selected four bit group which identifies the desired Boolean operation is outputted to Boolean raster-op 64 which then combines the source and destination data by way of the Boolean operation specified by plane raster-op select 62.

The result of the combination of the font source data and the frame buffer destination data $D_{0,0}$-$D_{7,7}$ is supplied to latch 74 for outputting therefrom to memory interface 14 of FIG. 1. Memory interface 14 then writes the new destination data into frame buffer 13 at a memory location specified by an address supplied by the CPU 9.

In this fashion, the present invention implements the unique feature of using background and foreground color information to determine the Boolean operation for combining the source and destination data.

Figure 3:
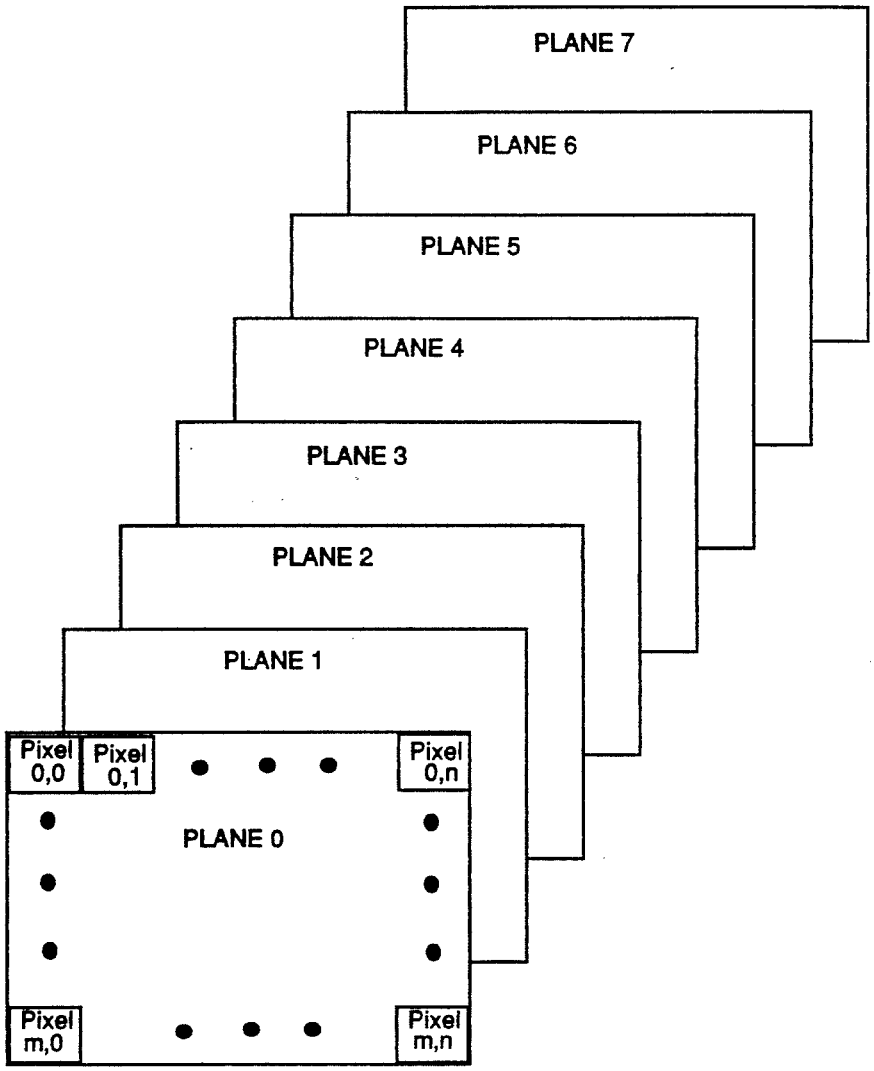
FIG. 3 is a diagramatic representation of the eight planes of information in a frame buffer.

The above combining of data is performed one plane at a time in the frame buffer memory since, in the preferred embodiment of the invention, the frame buffer memory is divided into eight planes, each plane representing the pixels on a video display as shown in FIG. 3.

Referring again to FIG. 2, for line drawing, pattern register 27 is used. Pattern register 27 is supplied with pattern source data by CPU 9. The pattern register is, in the preferred embodiment, a 16 by 16 bit matrix of binary values and is supplied with an address by the CPU 9 which selects a 16 bit row as a desired source. The 16 bit row will ultimately, when displayed, repeat logically across an entire scan line of a video display, beginning with every 16th pixel thereof. Multiplexor 28, as controlled by CPU 9, selects the 16 bit parcel of pattern data from pattern register 27, in eight bit increments. Multiplexor 30, which is also controlled by CPU 9, then selects an eight bit increment and channels it to multiplexor 32, which, in turn, selects the eight bit parcel of information and channels the same to barrel shifter 36.

Barrel shifter 36, when supplying pattern information, is passive and acts as a pipeline without shifting the data bits over a predetermined number of bits and supplies an eight bit increment of pattern data to the latches 46, 48, 50, 52, 54, 56, 58 and 60. The eight bit increment of pattern data is replicated eight times by expand circuitry 42, such that the information is duplicated for each latch 46–60, such that each latch has 8 bits of pattern data.

The information contained in latches 46, 48, 50, 52, 54, 56, 58 and 60 are supplied, under CPU control, to Boolean raster-op circuit 64, which combines the source information supplied by pattern register 27 with destination data supplied by destination register 78 by way of a Boolean operation specified by CPU 9 as briefly described above and as will be described in detail below with reference to FIG. 4. The result of the combination of the pattern source data and the frame buffer destination data is supplied to latch 74 for outputting therefrom to memory interface 14 of FIG. 1. Memory interface 14 then writes the new destination data into frame buffer 13 at a memory location specified by an address supplied by the CPU 9.

Figure 2:
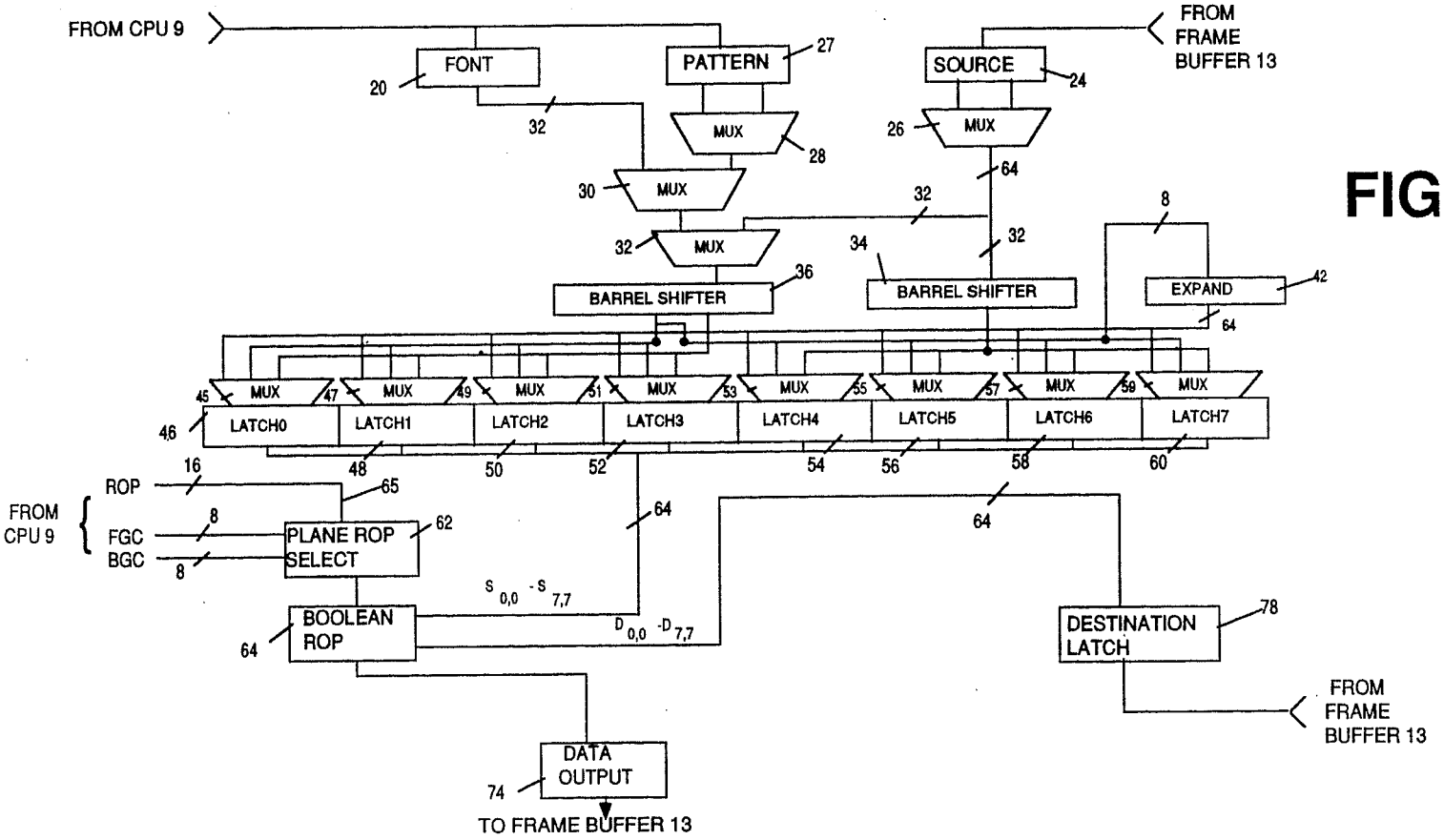
FIG. 2 is a block diagram of the data path circuitry which comprises the present invention.

Another operation supported by the data path circuitry 12 of FIG. 2 is block image transfers (BLIT). In this case, the source data is data which is stored in the frame buffer. Accordingly, source block register 24 is coupled to memory interface 14, which in turn, is coupled to the frame buffer 13. An addressed block of frame buffer source data is read from the frame buffer 13 and channeled to source block register 24 which, in turn, outputs frame buffer source data to multiplexor 26 under CPU 9 control. multiplexor 26 outputs the frame buffer source data, in eight pixel increments, to barrel shifter 34. Barrel shifters 34 and 36 align the source frame buffer data with the destination frame buffer data supplied from destination latch 78 as controlled by the CPU 9. The latches 46, 48, 50, 52, 54, 56, 58 and 60 latch and and then release the frame buffer data to Boolean raster-op 64. Boolean raster-op 64 implements a Boolean operation specified by the CPU 9 to combine the frame buffer source and destination data as described above and provides the combined data to destination latch 74 for writing, via memory interface 14, to frame buffer 13.

Figure 4:
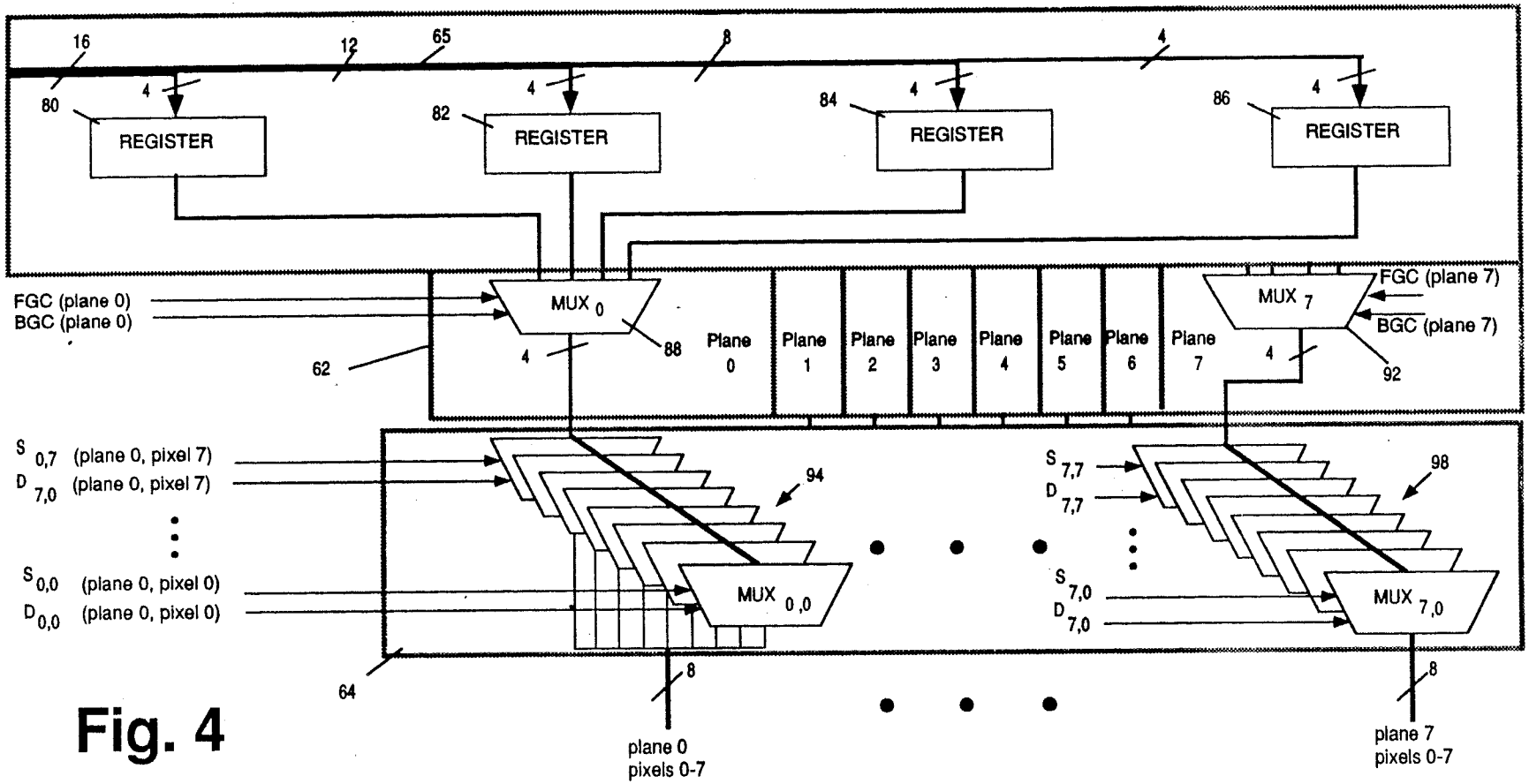
FIG. 4 is a block diagram of plane raster-op select logic 62 and Boolean raster-op logic 64.

In FIG. 4 there is shown a functional block diagram of plane-raster-op select 62 and Boolean-raster-op circuit 64. As shown in FIG. 3, frame buffer memory 13 is divided into eight planes. Each plane contains, in the XY direction, each pixel of the video display. The circuitry of FIG. 4 writes to each plane in the following fashion. Registers 80, 82, 84 and 86 each identifY one of sixteen possible Boolean operations by each storing a four bit code. Table 1 shows the sixteen Boolean operation and their 4 bit codes. As noted above, this information is supplied by the CPU on line 65 of FIG. 2. Plane raster-op select 62 is further comprised of eight 4:1 multiplexors, one for each of eight planes, only two of which, 88 and 92, are shown in FIG. 4. A description of the operation of multiplexor 88 of FIG. 4 will convey an understanding of the operation of the other seven 4:1 multiplexors of plane raster-op select 62, each of which operates in the same manner.

Multiplexor 88, selects one of the four registers 80, 82, 84 and 86 as determined by the combination of foreground and background bits presented on the FGC and BGC inputs of multiplexor 88. The selected four bits output from multiplexor 88 correspond to plane 0 of FIG. 4. Since, there are eight pixels of information which must be generated, this information must be duplicated eight times. Thus, for each multiplexor of plan-raster-op select 62, there are eight corresponding multiplexors included within Boolean raster-op 64. For example, for plane 0, there are eight multiplexors 94 and for plane 7, there are eight multiplexors 98.

The selected four bits are provided for each of the eight planes of memory such that 64 bits of source data and 64 bits of destination data are operated on by the 64 multiplexors of Boolean raster-op 64 using a Boolean operation selected by plane raster-op select 62. Specifically, and referring to MUXes 94, the four bits output from PUX 88 represent the results from a truth table for the selected Boolean operation. For example, referring to Table 1, if the Boolean operation is INVERT, the number of the operation is 5 which represents a bit pattern of 0101. The truth table for INVERT may be represented as follows:

| SOURCE | DESTINATION | RESULT (INVERT DESTINATION) |
|---|---|---|
| 1 | 1 | 0 |
| 1 | 0 | 1 |
| 0 | 1 | 0 |
| 0 | 0 | 1 |

Which result of course is the same as the number of the Boolean operation. Thus, if the $D_{0,0}$ input to MUX 0,0 is 1 and the $S_{0,0}$ input is 0 (which for INVERT is actually a don't care), the 0 1 0 1 input from MUX 88 causes MUX 0,0 to output a 0. In this manner, by utilizing what are ordinarily control inputs to MUXes 94 at data, and by utilizing what are ordinarily data inputs as control, a fast and relatively inexpensive technique for performing Boolean raster operations is created.

This combination of source and destination data is channeled to destination data output latch 74, which will, in turn, release the new destination data for writing to a location in the frame buffer memory determined by an address provided by the CPU 9.

It will also be appreciated that the above-described invention may be embodied in other specific forms without departing from the spirit or scope thereof. The foregoing description, therefore, should be viewed as illustrative and not restrictive, the scope of the invention being set forth in the following claims.

We claim:

1. An apparatus including a central processing unit for generating control signals including background color control signals and foreground color control signals, said apparatus for performing Boolean raster operations on source and destination data for storage in a frame buffer memory for a plurality of planes, said source data being selected from one of a font register, a pattern register and a source block register, said destination data being selected from said frame buffer, said apparatus comprising:

(a) source data select means coupled to said font register, pattern register and source block register for selecting source data;

(b) plane Boolean raster operation select means coupled to said central processing unit for selecting a Boolean raster operation to be performed for each of said plurality of planes using said foreground color and background color control signals generated by said central processing unit;

(c) Boolean raster operation circuit means coupled to said plane Boolean raster operation select means, said source data select means and said frame buffer for performing the selected Boolean raster operation for each of said plurality of planes on said source data and said destination data for storage in said frame buffer.

2. The apparatus defined by claim 1 wherein said plane Boolean raster operation select means comprises:

(a) a plurality of registers coupled to said central processing unit for storing predetermined Boolean raster operations generated by said central processing unit;

(b) a plurality of multiplexors corresponding to said plurality of planes for selecting for each of said planes a Boolean raster operation stored in one of said plurality of registers, each of said multiplexors having a corresponding foreground color control signal and a background color control signal generated by said central processing unit and used by said multiplexor to select said Boolean raster operation to be performed for a corresponding one of said planes.

3. The apparatus defined by claim 1 wherein said Boolean raster operation circuit means comprises a plurality of multiplexors corresponding to said plurality of planes, the data inputs to each of said plurality of multiplexors being the Boolean raster operation selected by said plane Boolean raster operation select means, the control inputs to said plurality of multiplexors being said source data and said destination data.

4. An apparatus including a central processing unit for generating control signals including background color control signals and foreground color control signals, said apparatus for performing Boolean raster operations on source and destination data for storage in a frame buffer memory for a plurality of planes, said source data being selected from one of a font register, a pattern register and a source block register, said destination data being selected from said frame buffer, said apparatus comprising:

(a) source data select means coupled to said font register, pattern register and source block register for selecting source data;

(b) plane Boolean raster operation select means coupled to said central processing unit for selecting a Boolean raster operation to be performed for each of said plurality of planes using said foreground color and background color control signals generated by said central processing unit wherein said plane Boolean raster operation select means includes:

(i) a plurality of registers coupled to said central processing unit for storing predetermined Boolean raster operations generated by said central processing unit;

(ii) a plurality of multiplexors corresponding to said plurality of planes for selecting for each of said planes a Boolean raster operation stored in one of said plurality of registers, each of said multiplexors having a corresponding foreground color control signal and a background color control signal generated by said central processing unit and used by said multiplexor to select said Boolean raster operation to be performed for a corresponding one of said planes;

(c) Boolean raster operation circuit means coupled to said plane Boolean operation select means, said source data select means and said frame buffer for performing the selected Boolean raster operation for each of said plurality of planes on said source data and said destination data for storage in said frame buffer wherein said Boolean raster operation circuit means comprises a plurality of multiplexors corresponding to said plurality of planes, the data inputs to each of said plurality of multiplexors being the Boolean raster operation selected by said plane Boolean raster operation select means, the control inputs to said plurality of multiplexors being said source data and said destination data.

5. A method for performing Boolean raster operations on source and destination data for storage in a frame buffer memory for a plurality of planes in a workstation including a central processing unit for generating control signals including background color control signals and foreground color control signals, said source data being selected from one of a font register, a pattern register and a source block register, said destination data being selected from said frame buffer, said method comprising the steps of:

(a) selecting source data from one of said font register, said pattern register and said source block register;

(b) selecting a Boolean raster operation to be performed for each of said plurality of planes using said foreground color and background color control signals generated by said central processing unit;

(c) performing the selected Boolean raster operation for each of said plurality of planes on said source data and said destination data for storage in said frame buffer.

6. The method defined by claim 5 wherein said plane Boolean raster operation selecting step comprises the steps of:

(a) inputting to a plurality of registers coupled to said central processing unit a predetermined Boolean raster operations generated by said central processing unit;

(b) selecting for each of said planes a Boolean raster operation stored in one of said plurality of registers, using a corresponding foreground color control signal and a background color control signal generated by said central processing unit to select said Boolean raster operation to be performed for a corresponding one of said planes.

7. The method defined by Claim 5 wherein said Boolean raster operation performing step comprises the step of inputting into a plurality of multiplexors corresponding to said plurality of planes, the Boolean raster operation selected by said plane Boolean raster operation selecting step, the control inputs to said plurality of multiplexors being said source data and said destination data.

* * * * *

UNITED STATES PATENT AND TRADEMARK OFFICE

CERTIFICATE OF CORRECTION

PATENT NO. : 4,958,146

DATED : 9/18/90

INVENTOR(S) : Priem et al.

It is certified that error appears in the above-identified patent and that said Letters Patent is hereby corrected as shown below:

| | | |
|---|---|---|
| [57] Abstract, line 01 | delete "mulitplexor" | insert --multiplexor-- |
| [57] Abstract, line 02 | delete "operation" | insert --operations-- |
| [57] Abstract, line 11 | after "to" | insert --a-- |
| col. 01, line 61 | delete "interface 4" | insert --interface 14-- |
| col. 02, line 41 | delete "then" | insert --When-- |
| col. 03, line 42 | delete "( (d)↑(s) ) | insert --( (d)∧(s) )-- |
| col. 03, line 44 | delete "(d)↑~(s) )" | insert --(d)∧~(s) )-- |
| col. 03, line 54 | delete "~ = EXCLUSIVE OR" | insert --∧ = EXCLUSIVE OR-- |
| col. 05, line 10 | delete "multiplexor" | insert --Multiplexor-- |
| col. 05, line 30 | delete "identifY" | insert --identify-- |
| col. 05, line 51 | delete "plan- " | insert --plane- -- |
| col. 05, line 62 | delete "PUX" | insert --MUX-- |

Signed and Sealed this

Twenty-third Day of March, 1993

*Attest:*

STEPHEN G. KUNIN

*Attesting Officer*

*Acting Commissioner of Patents and Trademarks*